US008063829B2

(12) United States Patent
Hung et al.

(10) Patent No.: US 8,063,829 B2
(45) **Date of Patent: *Nov. 22, 2011**

(54) COMPLEX ANTENNA

(75) Inventors: Chen-Ta Hung, Tu-cheng (TW); Po-Kang Ku, Tu-cheng (TW); Shu-Yean Wang, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 525 days.

This patent is subject to a terminal disclaimer.

(21) Appl. No.: 12/287,932

(22) Filed: Oct. 14, 2008

(65) Prior Publication Data

US 2009/0135070 A1 May 28, 2009

(30) Foreign Application Priority Data

Nov. 26, 2007 (TW) ..... 96144713 A

(51) Int. Cl.
*H01Q 1/38* (2006.01)

(52) U.S. Cl. ..... 343/700 MS

(58) Field of Classification Search ..... 343/700 MS, 343/702, 846

See application file for complete search history.

(56) References Cited

U.S. PATENT DOCUMENTS

| | | | | |
|---|---|---|---|---|
| 7,602,343 | B2 * | 10/2009 | Takada et al. | 343/702 |
| 7,911,387 | B2 * | 3/2011 | Hill et al. | 343/700 MS |
| 2004/0257283 | A1 * | 12/2004 | Asano et al. | 343/702 |
| 2007/0030204 | A1 * | 2/2007 | Heng et al. | 343/702 |
| 2008/0316116 | A1 * | 12/2008 | Hobson et al. | 343/702 |

* cited by examiner

*Primary Examiner* — Huedung Mancuso

(74) *Attorney, Agent, or Firm* — Wei Te Chung; Andrew C. Cheng; Ming Chieh Chang

(57) ABSTRACT

A complex antenna (100) comprises a grounding patch (3) extending in a longitudinal direction and having opposite first and second sides; a first antenna (1) comprising a first radiating element (11), a second radiating element (12), a third radiating element (13), and a first connecting element (14); a second antenna (2) comprising a fourth radiating element (21), a fifth radiating element (22), and a second connecting element (23). A gap is formed in the middle portion of the second side of the grounding patch. The first connecting element extends from an end of the gap and comprises a first connecting arm coplanar with the grounding patch and a second connecting arm vertical to the grounding patch. The first connecting arm and the grounding patch is formed a slot. The second connecting element extends from an end of the grounding patch.

20 Claims, 6 Drawing Sheets

COMPLEX ANTENNA

BACKGROUND OF THE INVENTION

1. Field of the Invention

The present invention relates to an antenna, and more particularly to an complex antenna operating in WWAN and UWB.

2. Description of Prior Art

Wireless communication devices, such as cellular phones, notebook computers, electronic appliances, and the like, are normally equipped with an antenna for working in WWAN (Wireless Wide Area Network) that serves as a medium for transmission and reception of electromagnetic signals, such as date, audio, image, and so on. However, more and more people dissatisfy their electronic devices only work in WWAN. Making the portable electronic devices working in UWB (Ultra Wide Band) is a purpose of the many people.

In recent years, WWAN adopts three technical standards of GSM (Global System for Mobile Communication), GPS (Global Positioning System) and CDMA (Code Division Multiple Access). Operating frequency bands of the GSM are 900/1800 MHz, and operating frequency band of the GPS is 1.575 GHz. CDMA includes three kinds of technical standards: CDMA2000, WCDMA and TD-SCDMA. Operating frequency bands of the CDMA2000 are 800, 900, 1700, 1800, 1900, and 2100 MHz. Operating frequency bands of the WCDMA are 1800, 1900, and 2100 MHz. Operating frequency bands of the TD-SCDMA are 900, 1800, and 2100 MHz. The UWB operating frequency band is 3.1-4.8 GHz.

FIG. 1 and FIG. 2 illustrate a multi-band antenna including a WLAN antenna and a WWAN antenna. However, the multi-band antenna can not operating in UWB frequency band.

Hence, in this art, a complex antenna to overcome the above-mentioned disadvantages of the prior art will be described in detail in the following embodiment.

SUMMARY OF THE INVENTION

An object of the present invention is to provide a complex antenna which has wide range of frequency band.

To achieve the aforementioned object, the present invention provides a complex antenna comprising: a grounding patch extending in a longitudinal direction and having opposite first and second sides; a first antenna comprising a first radiating element, a second radiating element, a third radiating element, and a first connecting element; the first connecting element connecting the first, the second, the third radiating elements and the grounding patch; a second antenna comprising a fourth radiating element, a fifth radiating element, and a second connecting element; the second connecting element connecting the fourth radiating element, the fifth radiating element, and the grounding patch; a gap formed in the middle portion of the second side of the grounding patch; the first connecting element extending from an end of the gap and comprising a first connecting arm coplanar with the grounding patch and a second connecting arm vertical to the grounding patch; the first connecting arm and the grounding patch formed a slot; the second connecting element extending from an end of the grounding patch; the first antenna spaced apart from the second antenna in the longitudinal direction.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
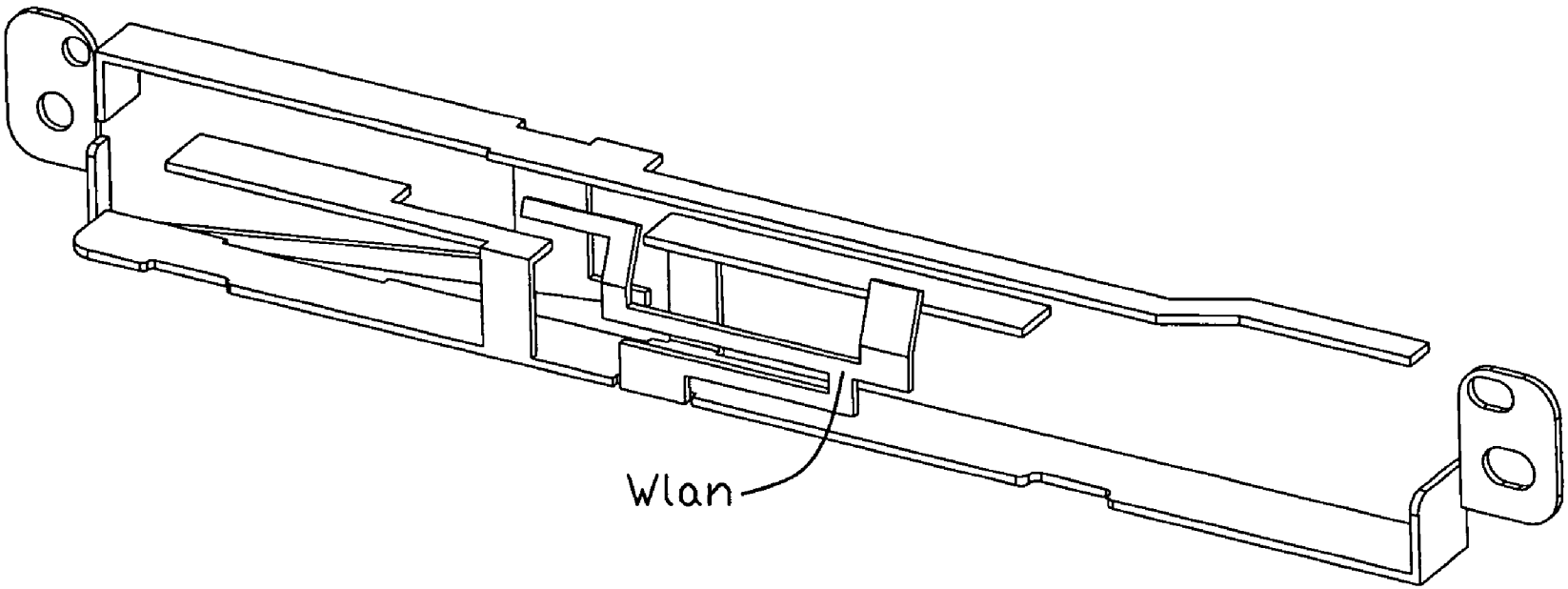
FIG. 1 is a perspective view of a conventional multi-band antenna.
Figure 2:
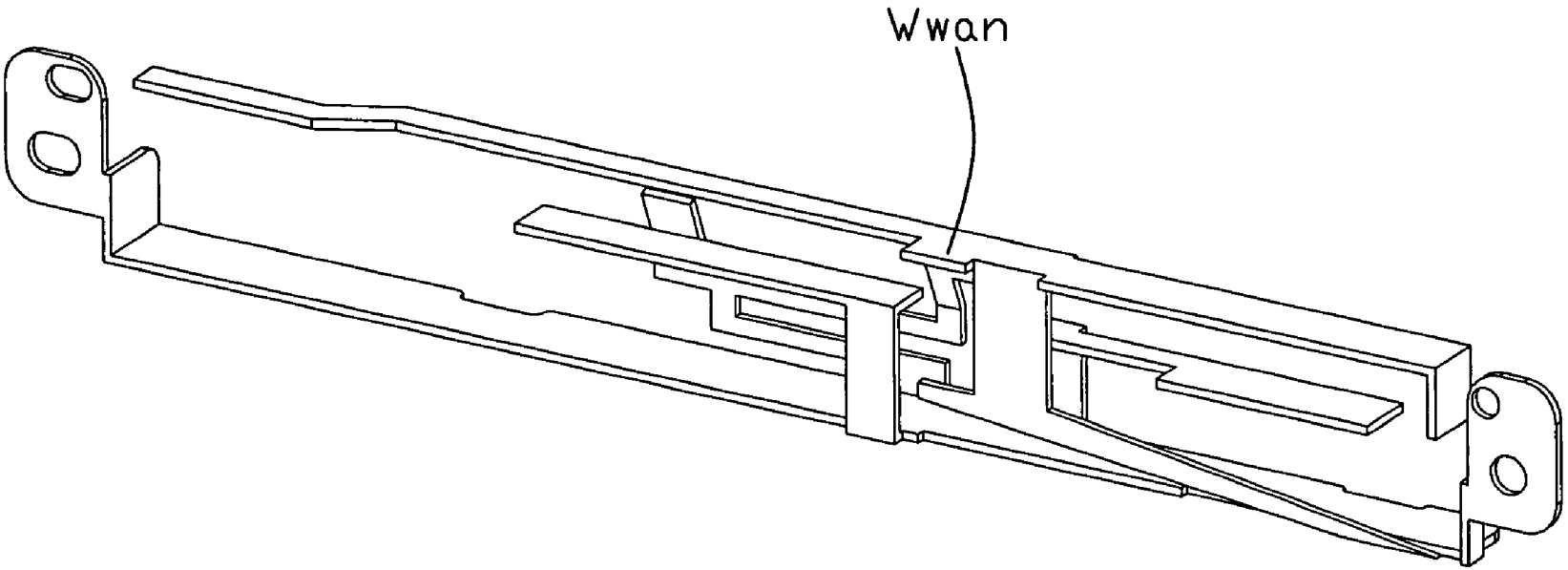
FIG. 2 is a view similar to FIG. 1, but from a different aspect.
Figure 3:
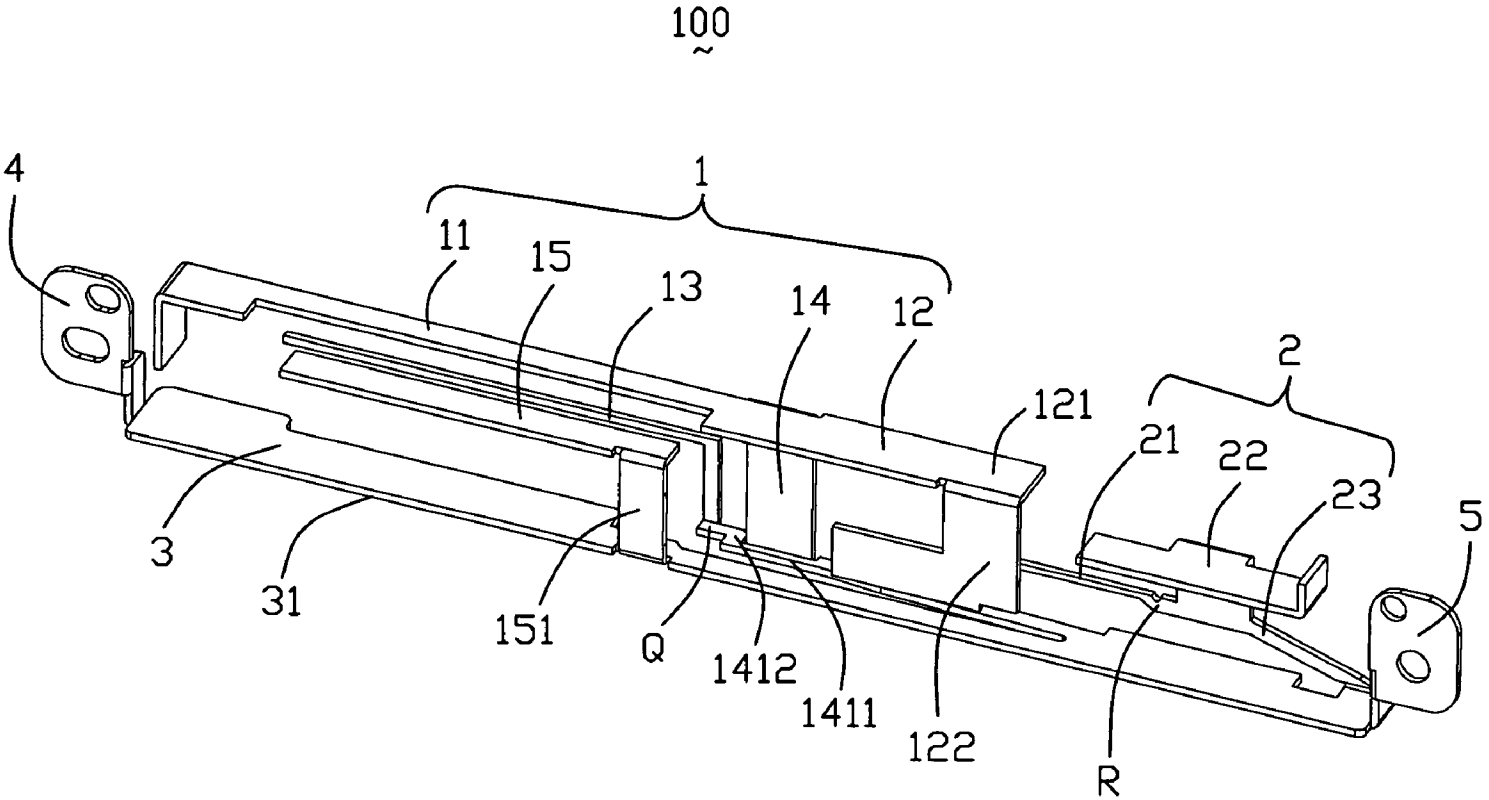
FIG. 3 is a perspective view of a complex antenna in accordance with a first embodiment of the present invention.
Figure 4:
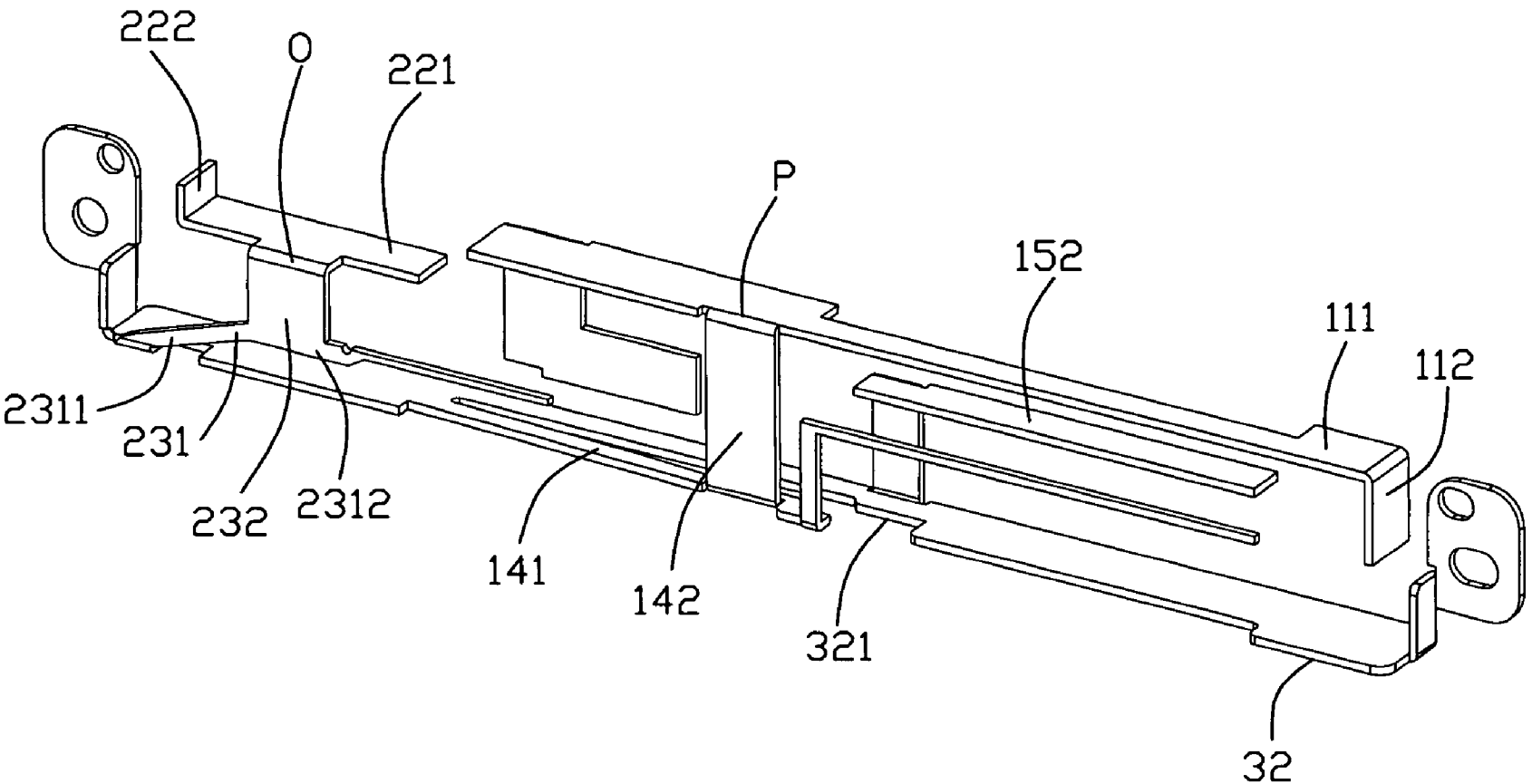
FIG. 4 is a view similar to FIG. 1, but from a different aspect.

Referring to FIGS. 3 and 4, a complex antenna 100 in accordance with a first embodiment of the present invention comprises a grounding patch 3, a first antenna 1, a second antenna 2, and a pair of installing element 4, 5.

The grounding patch 3 lying in a first plane extends in a longitudinal direction and has a first longitudinal side 31 and a second longitudinal side 32 having a gap 321.

The first antenna 1 operating in WWAN comprises a first radiating element 11, a second radiating element 12, a third radiating element 13, a first connecting element 14, and a coupling radiating element 15 extending vertically and upwardly from the first longitudinal side 31. The first radiating element 11, the second radiating element 12, and the third radiating element 13 are spaced apart from the grounding patch 3. The first connecting element 14 connects the first radiating element 11, the second radiating element 12, the third radiating element 13, and the grounding patch 3. The first connecting element 14 comprises a first connecting arm 141 extending from the grounding patch 3 and a second connecting arm 142 lying in a second plane and connecting the first connecting arm 141 and the first radiating element 11, the second radiating element 12. The first connecting arm 141 and the grounding patch 3 locate in the common first plane. The second connecting arm 142 lying in the second plane is vertical to the first connecting arm 141 and the grounding patch 3 lying in the first plane. The first connecting arm 141 and the grounding patch form a narrow slot. The first connecting arm 141 having Z-shape comprises a first longitudinal branch 1411 and a second L-shape branch 1412. The first radiating element 11, the second radiating element 12, and the second connecting arm 142 connect to a point P. The first connecting arm 141 and the third radiating element 13 joint to a first feeding point Q.

The first radiating element 11 comprises a first radiating branch 111 and a second radiating branch 112 extending downwardly and vertically from an end of the first radiating branch 111. The first radiating branch 111 locates in a third plane paralleling to the first plane. The second radiating branch 112 locates in a fourth plane perpendicular to the first plane and the second plane. The second radiating element 12 comprises a third radiating branch 121 lying in the third plane and a fourth radiating branch 122 extending from an end of the third radiating branch 121. The third radiating branch 121 and first radiating branch 111 connect to the point P. The fourth radiating branch 122 having L-shape locates in a fifth plane paralleling to the second plane. The third radiating element 13 having L-shape extends vertically from an end of the first branch 1412 of the first connecting arm 141. The third radiating element 13 locates in a sixth plane paralleling to the second plane. The second plane is between of the fifth plane and the six plane. The coupling radiating element 15 comprises a first coupling radiating branch 151 extending upwardly and vertically from a middle portion of the first side 31 and a second coupling radiating branch 152 extending vertically from an end of the first coupling radiating branch 151. The first coupling radiating branch 151 locates in the fifth plane. The second coupling radiating branch 152 locates a seventh plane paralleling to the third plane.

The second antenna 2 operating in UWB comprises a fourth radiating element 21, a fifth radiating element 22, and a second connecting element 23 extending from an end of the second side 32. The fourth radiating element 21, the fifth radiating element 22 are spaced apart from the grounding patch 3. The second connecting element 23 connects the fourth radiating element 21, the fifth radiating element 22, and the grounding patch 3. The second connecting element 23 comprises a third connecting arm 231 extending aslant and upwardly from an end of the second side 32 and a fourth connecting arm 232 extending vertically from an end of the third connecting arm 231. The third connecting arm 231 comprises a third connecting branch 2311 extending aslant and upwardly and a fourth connecting branch 2312 extending in a horizontal direction. The fourth connecting branch 2312 and the fourth radiating element 21 connect to a second feeding point R.

The fourth radiating element 21 and the second connecting element 23 locate in the second plane. The fifth radiating element 22 extending from an end of the fourth connecting arm 232 connects the fourth connecting arm to a point O. The fifth radiating element 22 comprises a fifth radiating branch 221 paralleling to the first plane and a sixth radiating branch 222 extending vertically and upwardly from an end of the fifth radiating branch 221.

The complex antenna 100 comprises a first feeding line (not shown) and a second feeding line (not shown). The first feeding line comprises a first inner conductor electrically connecting to the first feeding point Q and a first outer conductor electrically connecting to the grounding patch 3. The second feeding line comprises a second inner conductor electrically connecting to the second feeding point R and a second outer conductor electrically connecting to the grounding patch 3.

Figure 5:
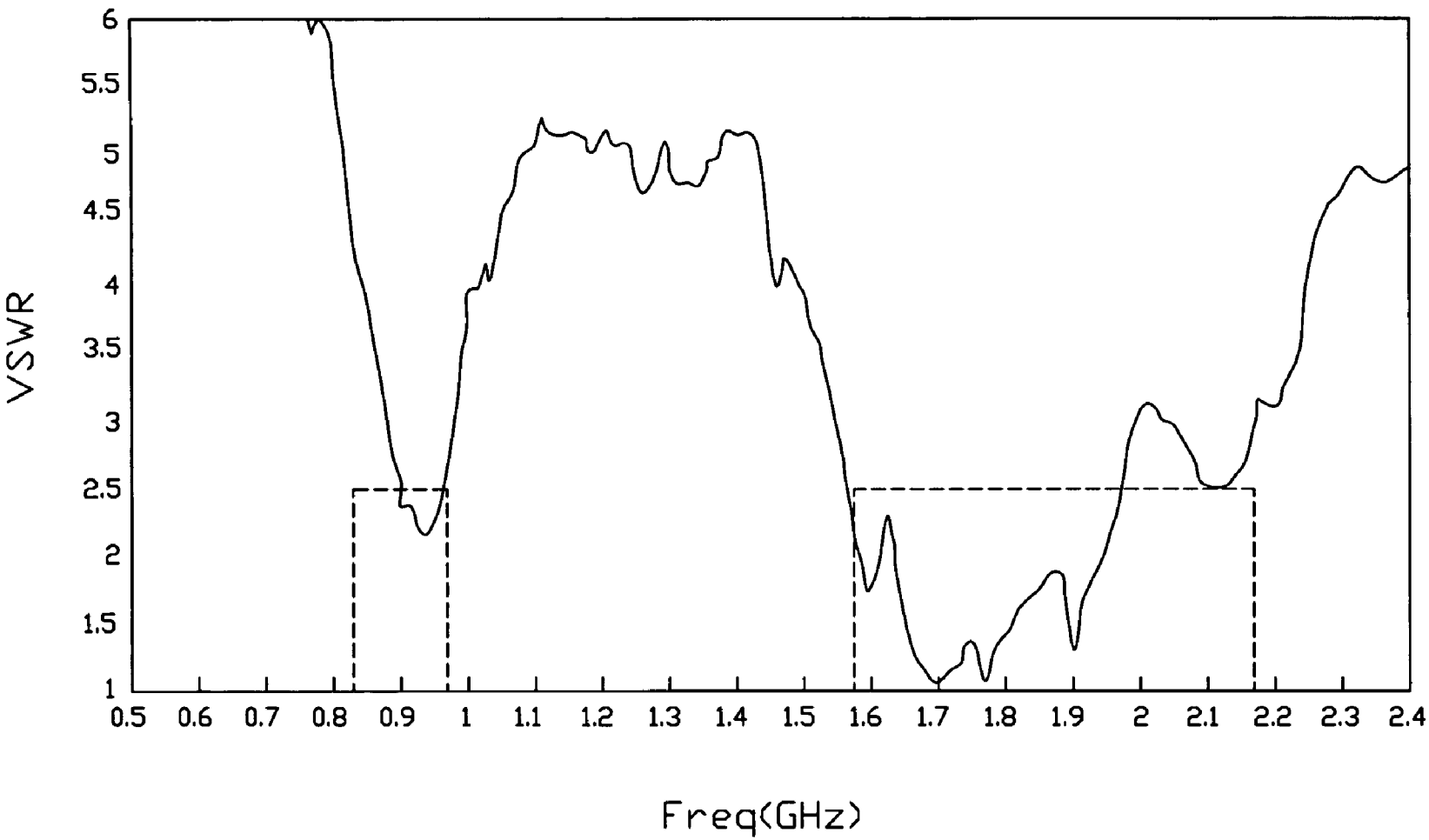
FIG. 5 is a test chart recording for the first antenna of the complex antenna in accordance with a first embodiment of the present invention, showing Voltage Standing Wave Ratio (VSWR) as a function of WWAN frequency.

FIG. 5 is a test chart of Voltage Standing Wave Ratio of the first antenna 1 of the complex antenna 100. Referring to FIG. 5, operating frequency band of the first antenna 1 are 820 MHz-960 MHz and 1580 MHz-2200 MHz. Above-mentioned operating frequency band has covered all of the frequency bands of the WWAN.

Figure 6:
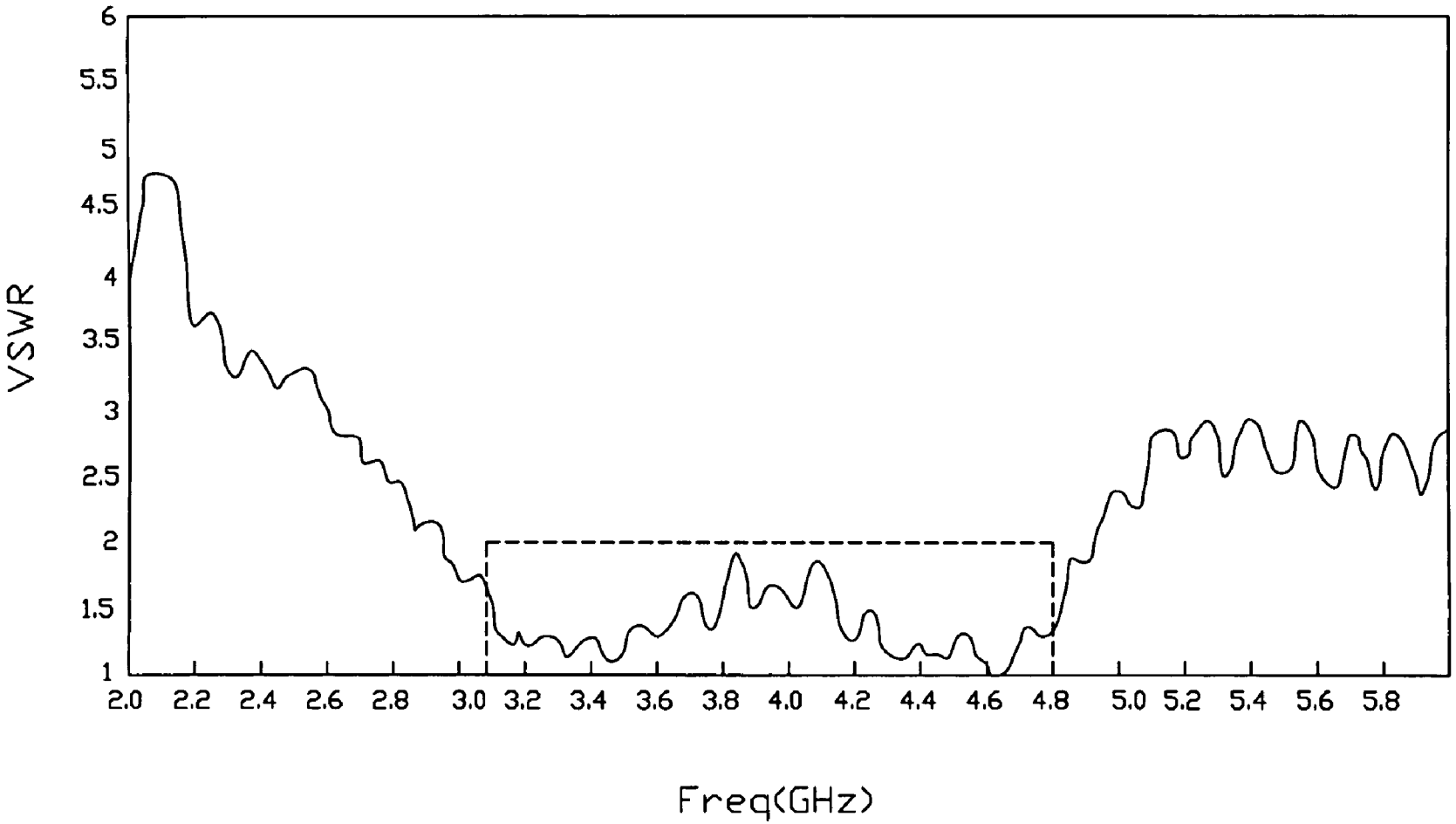
FIG. 6 is a test chart recording for the second antenna of the complex antenna in accordance with a first embodiment of the present invention, showing Voltage Standing Wave Ratio (VSWR) as a function of UWB frequency.

FIG. 6 is a test chart of Voltage Standing Wave Ratio of the second antenna 2 of the complex antenna 100. Referring to FIG. 6, operating frequency band of the second antenna 2 are 3.1 GHz-4.8 GHz. Above-mentioned operating frequency band accords with the frequency bands of the UWB.

The complex antenna 100 of the present invention reasonably uses solid space to make the first antenna 1 and the second antenna 2 having no spatial overlapping. Each radiating element of the complex antenna 100 are bended reasonably to ensure having miniaturization structure and simultaneity having favorable performance and frequency width.

What is claimed is:

1. A complex antenna, comprising:

a grounding patch extending in a longitudinal direction and having opposite first and second sides;

a first antenna comprising a first radiating element, a second radiating element, a third radiating element, and a first connecting element connecting the first, the second, the third radiating elements and the grounding patch;

a second antenna comprising a fourth radiating element, a fifth radiating element, and a second connecting element connecting the fourth radiating element, the fifth radiating element, and the grounding patch; wherein a gap is formed in the middle portion of the second side of the grounding patch; the first connecting element extends from an end of the gap and comprises a first connecting arm coplanar with the grounding patch and a second connecting arm vertical to the grounding patch; the first connecting arm and the grounding patch formed a slot; the second connecting element extending from an end of the grounding patch; the first antenna spaced apart from the second antenna in the longitudinal direction.

2. The complex antenna as claimed in claim 1, wherein said first connecting element and the second connecting element extend from the second side of the grounding patch.

3. The complex antenna as claimed in claim 1, wherein said first connecting arm of the first connecting element has a Z-shape structure.

4. The complex antenna as claimed in claim 1, wherein said second connecting element comprises a third connecting arm extending aslant and upwardly from the end of the grounding patch and a fourth connecting arm extending from an end of the third connecting arm.

5. The complex antenna as claimed in claim 1, wherein said first radiating element operating in 820 MHz-960 MHz frequency band; the second radiating element and the third radiating element formed a frequency band operating in 1.58 GHz-2.2 GHz, the fourth radiating element and the fifth radiating element formed a frequency band operating in 3.1 GHz-4.8 GHz.

6. The complex antenna as claimed in claim 1, wherein said complex antenna comprises an L-shape coupling radiating element extending vertically from the first side.

7. The complex antenna as claimed in claim 1, wherein said first connecting element connects the third radiating element to a first feeding point; said first antenna comprises a first feeding line comprising a first inner conductor electrically connecting to the first feeding point.

8. The complex antenna as claimed in claim 1, wherein said second connecting element connects the fourth radiating element to a second feeding point; said second antenna comprises a second feeding line comprising a second inner conductor electrically connecting to the second feeding point.

9. A complex antenna comprising:

a grounding patch extending in a longitudinal direction and having opposite first and second sides;

a first antenna comprising a first radiating element, a second radiating element, a third radiating element, and a first connecting element connecting the first, the second, the third radiating elements and the grounding patch;

a second antenna comprising a fourth radiating element, a fifth radiating element, and a second connecting element connecting the fourth radiating element, the fifth radiating element, and the grounding patch; wherein the first connecting element comprises a first connecting arm coplanar with the grounding patch and a second connecting arm vertical to the grounding patch; the first connecting arm and the grounding patch form a slot; the first radiating element operating in lower frequency band of the WWAN; the second radiating element and the third radiating element operates in higher frequency band of the WWAN; the fourth radiating element and the fifth radiating element operates in UWB.

10. The complex antenna as claimed in claim 9, wherein said first connecting arm and the grounding patch is formed a slot; the second connecting element extends from an end of the grounding patch; the first antenna spaced apart from the second antenna in the longitudinal direction.

11. The complex antenna as claimed in claim 9, wherein said first connecting element and the second connecting element extend from the second side of the grounding patch.

12. The complex antenna as claimed in claim 9, wherein said first connecting arm of the first connecting element has a Z-shaped configuration.

13. The complex antenna as claimed in claim 9, wherein said second connecting element comprises a third connecting arm extending aslant and upwardly from the end of the grounding patch and a fourth connecting arm extending from an end of the third connecting arm.

14. The complex antenna as claimed in claim 9, wherein said first connecting element connects the third radiating element to a first feeding point; said first antenna comprises a first feeding line comprising a first inner conductor electrically connecting to the first feeding point.

15. The complex antenna as claimed in claim 9, wherein said second connecting element connects the fourth radiating element to a second feeding point; said second antenna comprises a second feeding line comprising a second inner conductor electrically connecting to the second feeding point.

16. A complex antenna comprising:

an elongated grounding patch extending along a longitudinal direction with two opposite first and second elongated side regions thereof, a recess formed in a middle portion of said first elongated side toward the second elongated side region;

a first antenna extending from said recess and including:

a first connecting element having a first connecting arm extending from the first side region in a coplanar manner so as to form a first slot extending essentially along the longitudinal direction between the first connecting arm and the grounding patch in a first plane defined by said grounding patch and said first connecting arm; and first and second radiating elements extending from said first connecting element opposite to the grounding patch;

a second antenna on one of said first and second side regions and including:

a second connecting element extending from said one of the first and second side regions in a second plane angled to the first plane so as to form a second slot extending essentially along said longitudinal direction between the second connecting element and the grounding patch in said second plane; and a third radiating element extending from the second connecting element opposite to said grounding patch;

a first feeding line having a first inner conductor connected to the first connecting element and a first outer conductor connected to the grounding patch; and a second feeding line having a second inner conductor connected to the second connecting element and a second outer conductor connected to the grounding patch.

17. The complex antenna as claimed in claim 16, wherein said second antenna extends from said first side region.

18. The complex antenna as claimed in claim 16, wherein said first connecting element further includes a second connecting arm extending from the first connecting arm in said second plane under a condition that said first and second radiating elements extend from said second connecting arm.

19. The complex antenna as claimed in claim 16, further including a fourth radiating element extending from the first connecting arm in said second plane.

20. The complex antenna as claimed in claim 16, further including a coupling radiating element extending from said second side region in the second plane for coupling to the first antenna.

* * * * *